US005153413A

United States Patent [19]

Wilde

[11] Patent Number: 5,153,413

[45] Date of Patent: Oct. 6, 1992

[54] ELECTRIC RADIANT HEATING ELEMENT

[75] Inventor: Eugen Wilde, Knittlingen, Fed. Rep. of Germany

[73] Assignee: E.G.O. Elektro-Gerate Blanc u. Fischer, Fed. Rep. of Germany

[21] Appl. No.: 729,367

[22] Filed: Jul. 12, 1991

[30] Foreign Application Priority Data

Jul. 15, 1990 [DE] Fed. Rep. of Germany ..... 4022292

[51] Int. Cl.[5] ..... H05B 3/74

[52] U.S. Cl. ..... 219/463; 219/466; 219/445

[58] Field of Search ..... 219/463, 464, 465, 466, 219/445, 446, 458, 459, 460, 467

[56] References Cited

U.S. PATENT DOCUMENTS

| | | | |
|---|---|---|---|
| 1,348,648 | 8/1920 | Kelly | 219/466 |
| 1,417,154 | 5/1922 | Finizio | 219/458 |
| 1,534,673 | 4/1925 | Weir | 219/466 |
| 4,778,978 | 10/1988 | Schreder | 219/464 |
| 4,931,621 | 6/1990 | Goessler | 219/466 |

FOREIGN PATENT DOCUMENTS

| | | |
|---|---|---|
| 0223966 | 3/1987 | European Pat. Off. . |
| 0303854 | 2/1989 | European Pat. Off. . |
| 3204760 | 8/1983 | Fed. Rep. of Germany . |
| 3315438 | 10/1984 | Fed. Rep. of Germany . |
| 8706277 | 6/1987 | Fed. Rep. of Germany . |
| 8711209 | 10/1987 | Fed. Rep. of Germany . |
| 3622415 | 1/1988 | Fed. Rep. of Germany . |

*Primary Examiner*—Teresa J. Walberg
*Attorney, Agent, or Firm*—Quarles & Brady

[57] ABSTRACT

A radiant heating element (11) contains on the surface (16) of an insulating support (14) heating resistors (18), which emanate from terminals (20), which are arranged in regular spacings on the outer circumference of the heating area (21) and are connected there to semicircular ring circuits (22, 23). The heating resistors run from the outside to the inside in nested double spirals (30, 31), reverse there in return bends (32) and then run parallel back again to the outside. This gives a very uniform, almost completely symmetrical arrangement, so that the glowing state is rapidly reached and a uniform glow pattern is obtained.

27 Claims, 2 Drawing Sheets

FIG. 3
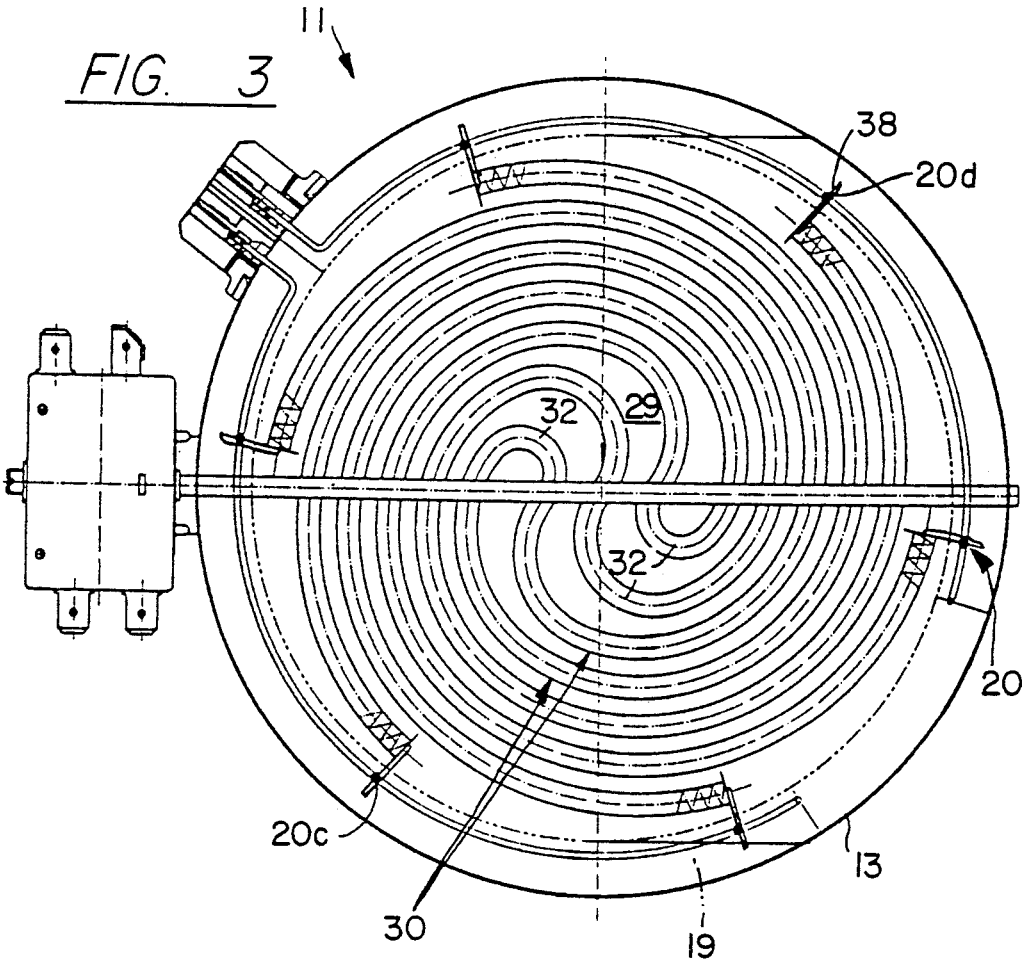
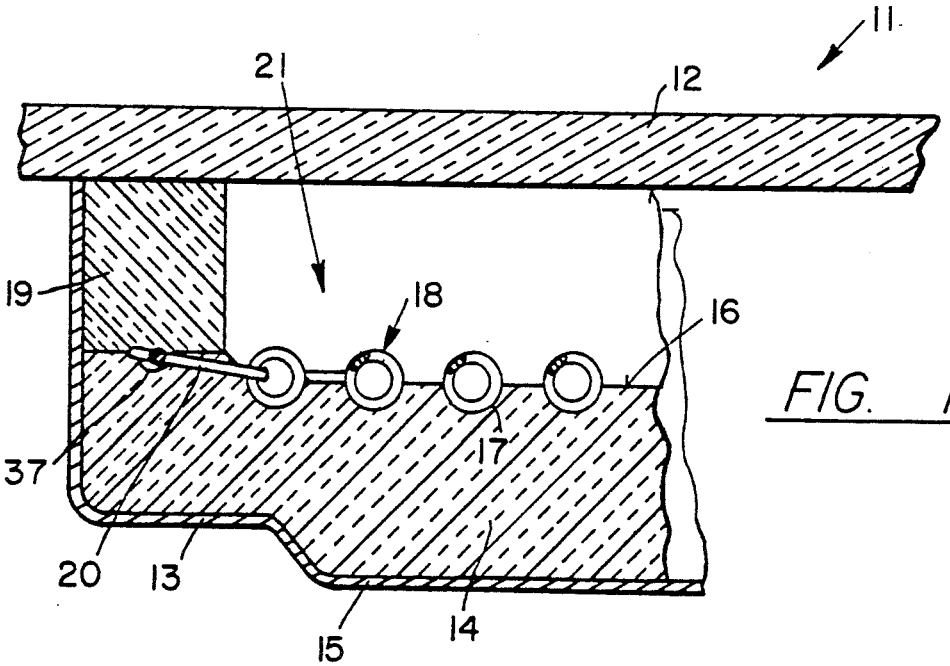
FIG. 1

ELECTRIC RADIANT HEATING ELEMENT

DESCRIPTION

1. Background of the Invention

The invention relates to an electric radiant heating element, particularly for heating cooking surfaces, such as glass ceramic plates, with an insulating material support and heating resistors with terminals arranged spirally thereon in a heating area.

2. Description of the Prior Art

Such a radiant heating element is known from DE-A-33 15 438. The heating resistors run in a double spiral, which has inner and outer terminals. They are directly juxtaposed substantially on the same radius. This leads to an asymmetry, i.e. a divergence from the ideal spiral shape, which increases with the number of parallel spirals. This is also apparent from DE-A-36 22 415, DE-U-87 06 277 and DE-U-87 11 209.

Instead of a spiral arrangement, it is also known to arrange the heating resistors in the form of double bends or arcs, which are partly open and have "protuberances" engaging in a central area. Although this arrangement makes it possible to insert terminals from the marginal region without having to pass over or under the heating resistors, it is optically unattractive and difficult to lay, particularly due to the many necessary narrow 180° bends.

OBJECT AND SUMMARY OF THE INVENTION

The object of the invention is to provide a radiant heating element, which permits a uniform heating surface covering. According to the invention this object is solved in that the terminals of all the heating resistors terminating at the outer rim of the heating area are distributed over the circumference in reciprocal circumferential spacings.

This leads to an arrangement of parallel spirals, which are approximately equidistant from one another and have a constantly increasing curvature from the outside to the inside until they change their direction in one or two return bends and then run outwards again.

This leads to two double spiral types. One, narrow double spiral has a narrower or closer return bend in the central area of the substantially circular heating element and two parallel, directly adjacent spiral portions, which end in two terminals, which although preferably having the same spacing from one another in the circumferential direction, are adjacent to one another. The other double spiral type, which can be referred to as a wide double spiral has two juxtaposed return bends arranged in the manner of a S, whereof the spiral portions run outwards. Between these is provided in each case at least one narrow double spiral.

Thus, several interengaging double spirals can be arranged in such a way that in the heating area they are substantially parallel and have a smaller reciprocal spacing than in the central area. This is very advantageous for heating in accordance with practical requirements, because the central zone is to be heated to a lesser extent. This arrangement is also very optically appealing, which is particularly important because the glow pattern can be seen through the glass ceramic plate and therefore also determines the optical appearance of an item of kitchen furniture. An almost completely symmetrical arrangement is created, which proves to be very ingenious.

All terminals and connections can take place from the outside. Thus, it is possible to operate in parallel two or more heating resistors, which brings about a rapid heating. It is consequently also possible to use a very highly thermally insulating material, which is usually not very mechanically strong and therefore does not make it possible to readily pass terminals from below into the central area. All the terminals can be uniformly supplied by a single ring circuit formed from two ring halves running over the support surface or in the marginal area thereof, or possibly even covered by the rim. The arrangement is such that in each case the terminals for each polarity are sequentially located on one side, i.e. all the terminals on one side are on the same circuit strand. This is made possible by the fact that each radiant heater only contains two narrow double spirals, which have juxtaposed terminals, whereas the other double spirals are wide spirals, whose terminals in each case border on the terminals of the narrow double spirals, so that each polarity is on one side. Therefore, it is also possible to provide several parallel-connected heating resistors, which leads to very rapid glowing. In this case the radiant heating element would be regulated by clocking, i.e. pulsewise switching on and off. However, it is also possible to individually connect the heating resistors and to e.g. switch them in a multiclock circuit (e.g. in seven-clock or timing manner), a control then taking place by combining single, parallel and series connection of the individual heating resistors. A control with two or more heating circuits differently switched by a single regulator or control device can also be appropriate, so as to e.g. provide a further cooking continuous power output with one heating resistor and then to switch in the other when the power to be consumed increases. This can e.g. take place by means of a thermostat with two or more switching contacts set to different temperatures. However, in all cases the good heating power distribution over the surface is maintained, as is the good overall optical appearance.

BRIEF FIGURE DESCRIPTION

These and other features of the invention can be gathered from the claims, description and drawings and the individual features can be realized in an embodiment of the invention and in other fields, either singly or in the form of subcombinations, and can represent advantageous, independently protectable constructions for which protection is here claimed. An embodiment of the invention is described in greater detail hereinafter relative to the drawings, wherein show:

FIG. 1 A diagrammatic cross-section through a radiant heater along line 1 in FIG. 2.

FIGS. 2 and 3 In each case a plan view of a radiant heating element.

DETAILED DESCRIPTION OF PREFERRED EMBODIMENTS

Figure 2:
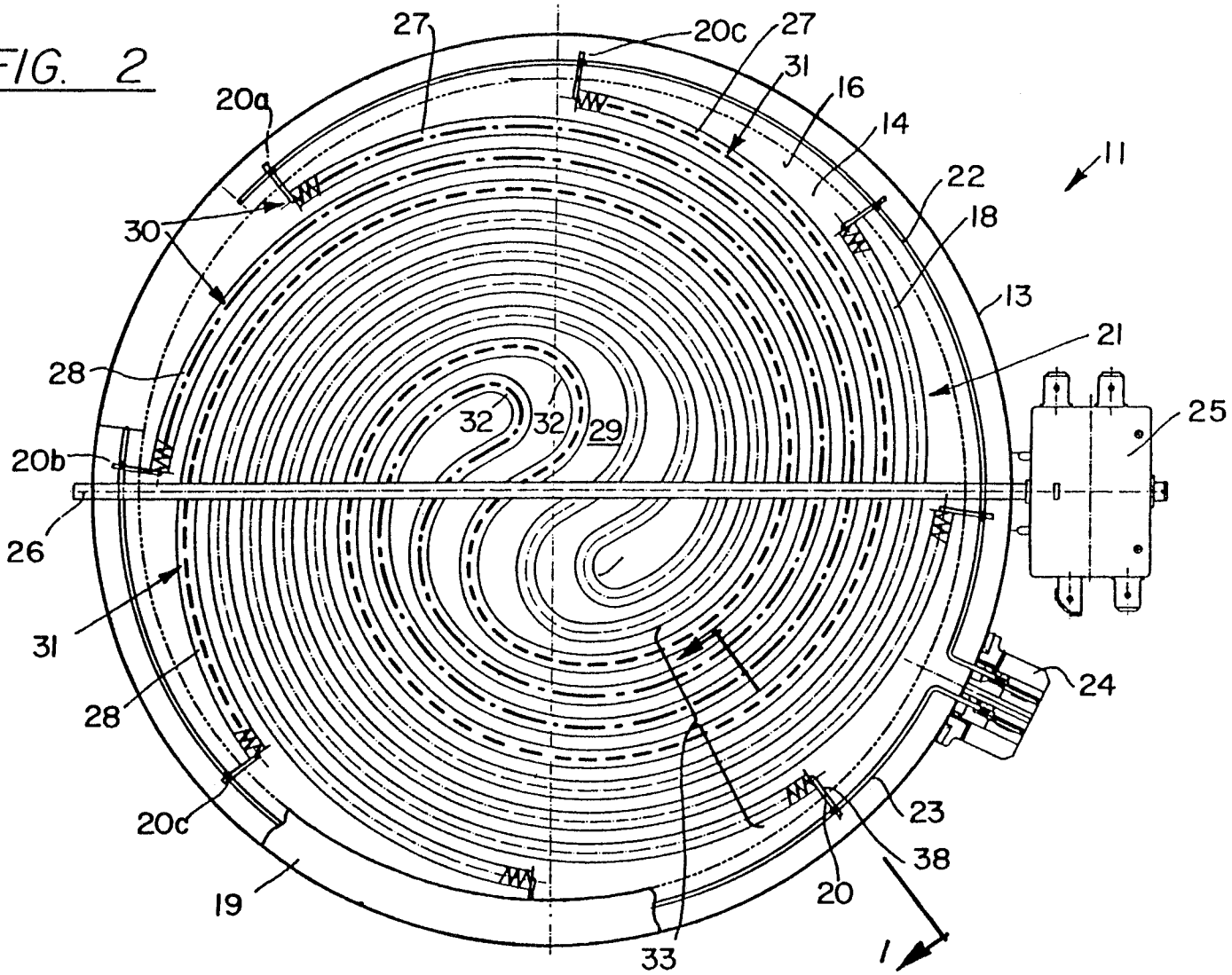

A radiant heating element 11 is positioned below a glass ceramic plate 12 of a cooking appliance to be heated, e.g. a hob or a cooker and is resiliently pressed onto its underside. In a flat support tray 13 made from sheet metal, the radiant heating element has an insulating material support, which comprises a pressed-in layer of a highly thermally insulating, heat-resistant and electrically insulating material, e.g. a pyrogenic silica aerogel, which is introduced into the tray as a relatively loose bulk material, optionally following prepressing, and is pressed there parallel to the flat bottom 15 of the tray. It is possible to press into the support surface 16 grooves 17, which guide a part of helical heating resistors 18 comprising electrical resistance wire and which are positioned on the said surface 16 and are secured there by pressing in, nailing down by means of clips driven into the support 14, etc.

An all-round rim 19 of a different insulating material is located on the surface of the support 14. It can e.g. be produced from a pressed, mineral fibre-containing insulating material, which is mechanically stronger than the material of the support 14, but has inferior thermal insulation properties. The upper edge of the rim 19 is supported on the glass ceramic plate 12.

The terminals 20 of the heating resistors 18 are all located on the outer circumference of the heating area 21 formed within the rim 19 and in each case distributed with the same circumferential spacing over the circumference (FIGS. 2 and 3). They are connected to a ring circuit, which comprises two ring circuit branches 22, 23. It is located between the rim and the support 14 in a slot 37, so that it is also covered in an electrically insulating manner.

The ring circuit branches 22, 23 just covering half the heating element circumference are connectable to leads by means of a connecting piece 24. The connection of the heating resistors 18 to the ring circuit can take place by means of welding hooks or pins 38, but also can take place directly.

FIG. 2 shows a radiant heating element with in all four heating resistors, whilst in FIG. 3 there are three heating resistors. They are connected in parallel to one another and in each case four (FIG. 2) or three (FIG. 3) juxtaposed terminals are connected to a ring circuit branch. Thus, the heating resistor arrangement is such that in the case of parallel connection in each case half the terminals with the same polarity are directly juxtaposed and consequently a ring circuit is possible without any skipping of a terminal.

A thermal cutout 25 with a cutout and a signal contact projects with its rod-like sensor 26 diametrically over the entire heating area 21 and through recesses in the rim 19 and the support tray 13. Due to the uniform heating resistor distribution it covers the entire heated surface in an optimum manner.

The overall arrangement of the heating resistors is spiral, namely in the form of double spirals, whereof there are two types in the represented embodiments. Although all the heating resistors can comprise identical wire filaments, which may also optionally have the same wire length, in FIGS. 2 and 3 they are shown with a different line routing in order to illustrate the two types of heating resistors, namely a narrow double spiral 30 is indicated by a dot-dash line and a wide double spiral 31 by a broken line.

The narrow double spiral 30 starts at two terminals 20*a*, 20*b*, which are juxtaposed and are namely separated from one another by the associated circumferential position by 45° (in the case of eight terminals on the circumference), without any other terminals being located between them. The spiral portions 27, 28 of the double spiral pass spirally inwards parallel to one another and, corresponding to the spiral shape, their curvature increases uniformly and constantly into a central region 29. In the latter the two spiral portions 27, 28 move somewhat apart and are interconnected by means of a return bend 32, which has roughly a 180° curvature.

The narrow double spiral 30 is surrounded by a wide double spiral 31. It commences at terminals 20*c* and 20*d*, which are in each case located with a $\frac{1}{8}$ circumferential spacing on either side of the terminals 20*a*, 20*b*. Their spiral portions 27, 28 are in parallel on both sides of the corresponding spiral portions of the inner double spiral 30. Here again the initially constant spacing between the spiral portions 27 of both double bends increases in the central region 29 and the corresponding return bend 32 is much larger.

In the case of the radiant heating element according to FIG. 2, two such narrow and wide double spirals are so nested that in the central region the return bends and the inner spiral portions connected thereto (28 in the case of the broken line double spiral 31) describe the shape of two nested S's, in whose return bends 32 are in each case located the return bend 32 of the narrow double spiral 30. With their outer spiral portions, the double spirals describe a spiral bend or arc of somewhat greater than 360°, whilst the inner spiral bend 28 describes an additional 45°. Thus, as a result of the in all eight spiral portions, an eight-turn spiral is formed, whose heating ring area, i.e. the outer part of the heating area 21 seen from the central region 29 has parallel heating coils in a relatively dense arrangement. In all, up to the centre there are eight parallel spiral portions.

It can be seen that the connection possibilities with the heating resistor arrangement mean that the terminals 20*a* and 20*c* are located on one ring circuit branch 22, whilst the in each case other terminals 20*b* and 20*d* of the double spirals are located on the ring circuit branch 23 with the other polarity.

The spiral arrangement of the heating resistors is not only very ingenious and optically attractive, but in a specific way is also symmetrical to almost all the diametral sectional planes, although in each case displaced in mirror-symmetrical manner. Considered mathematically, it is centrosymmetrical to the heating element centre. This symmetry also makes it possible to fit the heater in random positions without this having a disadvantageous action from the optical standpoint.

The heating element according to FIG. 3 has basically the same construction as that according to FIG. 2. As a result of its smaller diameter only three heating resistors are needed. Thus, there are in all six terminals on the outer circumference which are uniformly displaced by in each case 60°. Of the three heating resistors arranged in double spiral manner, two are narrow double spirals 30, in whose centre is provided a wide double spiral 31, which as a result of the fact that it surrounds with its central region the two return bends 32 of the narrow double spirals 30, it has a symmetrical S-curvature with two return bends 32 successively arranged in the same radius. The curvature of each spiral portion of the wide double spiral consequently increases significantly towards the interior, so that it is the same as that of the return bend 32. The wide double spiral 31 is in this case completely symmetrical in that its terminals 20*c*, 20*d* diametrically face one another. This is the case with any arrangement having an uneven number of double spirals. Constructions with a random number of double spirals in an even or uneven number are possible.

A major advantage is the small number of sharp bends, which are always at risk from heat. It is also advantageous that not only the individual double spirals, but also the individual spiral portions have almost the same length, so that the glow pattern is made uniform and manufacture is simplified. The tightly wound starting coils of the heating resistors can have the same length and also identical electrical values. Corresponding or similar arrangements are also possible with other heating element shapes, e.g. oval or angular, or also for creating cooking surfaces with switch-in lateral zones of asymmetrical heating surface shapes. In this case the spirals would not have the almost ideal spiral shape, as in the present case. However, the main advantages would still be obtained. It is also possible to have the double spirals describe a much larger or smaller angle than 360°, without any significant deterioration in the optical and practical effects.

Thus, a radiant heating element is obtained, which contains on the surface of an insulating support heating resistors, which emanate from terminals, which are arranged with regular spacings on the outer circumference of the heating area and are connected there to semicircular ring circuits. The heating resistors run from the outside to the inside in nested double spirals, reverse there in return bends and then run back again in parallel to the outside. This gives a very uniform, almost completely symmetrical arrangement, which makes it possible to rapidly achieve the glow state and give a uniform glow pattern.

As in the central region the same potential is present due to the parallel connection for all the heating resistors, they can also be combined there e.g. in one point or preferably in a ring circuit surrounding an unheated central zone. Thus, in this case in a construction with eight outer terminals as in FIG. 2, there would be eight individual spiral portions running towards the inner ring circuit. The free central zone can e.g. be important for the positioning of temperature or hot detection sensors.

I claim:

1. An electric radiant heating element having a support and heating resistors with terminals arranged spirally thereon in a heating area, wherein the terminals of all the heating resistors ending on the outer rim of the heating area are distributed over the circumference in reciprocal circumferential spacings, the terminals being connected to a ring circuit with ring circuit branches in each case surrounding substantially half the circumference of the heating element.

2. A radiant heating element according to claim 1, wherein the terminals are in each case arranged with the same reciprocal circumferential spacing.

3. A radiant heating element according to claim 1, wherein all the heating resistors are connected in parallel.

4. A radiant heating element according to claim 1, wherein all the juxtaposed terminals situated in one half of the circumference of the radiant heating element are connected to one ring circuit branch.

5. A radiant heating element according to claim 1, wherein all the terminals on the surface of the support are arranged on the rim of the heating area.

6. A radiant heating element according to claim 1, wherein the ring circuit is placed between an insulating rim and the support of the heating resistors.

7. An electric radiant heating element having a support and heating resistors with terminals arranged spirally thereon in a heating area, wherein the terminals of all the heating resistors ending on the outer rim of the heating area are distributed over the circumference in reciprocal circumferential spacings, at least one of said heating resistors being formed as a double spiral emanating from the central area of the heating element, at least one of the double spirals being a narrow double spiral having directly juxtaposed spiral portions emanating from a return bend, wherein at least one of the double spirals is a wide double spiral, the spiral portions of said wide double spiral surrounding substantially in parallel another double spiral preferably a narrow double spiral.

8. A radiant heating element according to claim 7, wherein all heating resistors are spirally arranged and having the same spiral rotation direction.

9. A radiant heating element according to claim 7, wherein two return bends of said wide double spiral are connected to each other substantially to form an "S".

10. A radiant heating element according to claim 7, wherein the heating resistors are spaced from each other, the spacing being larger in a central area than in an outer area of the heating element.

11. An electric radiant heating element having a support and heating resistors with terminals arranged spirally thereon in a heating area, wherein the terminals of all the heating resistors ending on the outer rim of the heating area are distributed over the circumference in reciprocal circumferential spacings, at least one of said heating resistors being formed as a double spiral emanating from the central area of the heating element, at least one of the double spirals being a narrow double spiral having directly juxtaposed spiral portions emanating from a return bend emanating from the center of the heating element, the return bends of the double spirals become narrower towards the outside.

12. An electric radiant heating element having a support and heating resistors with terminals arranged spirally thereon in a heating area, wherein the terminals of all the heating resistors ending on the outer rim of the heating area are distributed over the circumference in reciprocal circumferential spacings, at least one of said heating resistors being formed as a double spiral emanating from the central area of the heating element, at least one of the double spirals being a narrow double spiral having directly juxtaposed spiral portions emanating from a return bend, wherein inner spiral portions of two of the narrow double spirals enclose between them inner spiral portions of one or more wide double spirals.

13. An electric radiant heating element having a support and heating resistors with terminals arranged spirally thereon in a heating area, wherein the terminals of all the heating resistors ending on the outer rim of the heating area are distributed over the circumference in reciprocal circumferential spacings, at least one of said heating resistors being formed as a double spiral emanating from the central area of the heating element, at least one of the double spirals being a narrow double spiral having directly juxtaposed spiral portions emanating from a return bend, the heating element further containing two of the narrow double spirals and one or more wise double spirals.

14. An electric radiant heating element comprising:

a support with a heating area, said heating area extending within an outer rim and having a center;

at least three heating resistors arranged in the heating area on said support in spiral arrangement, said heating resistors including at least six spiral portions, each portion connecting the central area with the outer rim, all six portions extending in the same spiral rotation direction and being substantially equal in shape and length, said heating resistor being electrically connected constantly in parallel with each other and having at least six terminals, all of said six terminals terminating of the outer rim in equal reciprocal circumferential spacings.

15. A radiant heating element according to claim 14, wherein the terminals are connected to a ring circuit with ring circuit branches in each case surrounding substantially half the circumference of the heating element.

16. A radiant heating element according to claim 14, wherein at least one heating resistor being formed as a double spiral emanating from the central area of the heating element.

17. A radiant heating element according to claim 16, wherein the double spiral contains at least one return bend in the central area connecting two substantially parallel spiral portions.

18. A radiant heating element according to claim 17, wherein the return bends and parts of the spiral portions connected thereto having a curved drop shape.

19. A radiant heating element according to claim 17, wherein the curvature of the spiral portions increases steadily from the outside to the inside.

20. A radiant heating element according to claim 16, wherein in the central area one or two double spirals run in a central, S-shaped curve.

21. A radiant heating element according to claim 16, wherein at least one of the double spirals is a narrow double spiral, having directly juxtaposed spiral portions, emanating from a return bend.

22. A radiant heating element according to claim 21, wherein emanating from the centre of the heating element, the return bends of the double spirals become narrower towards the outside.

23. A radiant heating element according to claim 21, wherein inner spiral portions of two of the narrow double spirals enclose between them inner spiral portions of one or more wide double spirals.

24. A radiant heating element according to claim 21 containing two of the narrow double spirals and one or more wide double spirals.

25. A radiant heating element according to claim 14, wherein the heating resistors are interconnected in a central area of the heating element.

26. A radiant heating element according to claim 25, wherein said interconnection being in the form of a ring circuit surrounding said central area.

27. A radiant heating element according to claim 14, wherein at least one of the double spirals is a wide double spiral, the spiral portions of said wide double spiral surrounding substantially in parallel another double spiral, preferably a narrow double spiral.

* * * * *